US005865951A

United States Patent [19]

Kawakami et al.

[11] Patent Number: 5,865,951

[45] Date of Patent: Feb. 2, 1999

[54] PROCESS FOR MAKING PAPER

[75] Inventors: Shigenao Kawakami, Ilkoma-gun; Nobuyuki Matsuda, Sakai; Hiroshi Horiuchi, Toyonaka; Norio Kondo, Minoo, all of Japan

[73] Assignee: Sumitomo Chemical Company, Limited, Osaka-fu, Japan

[21] Appl. No.: 937,374

[22] Filed: Sep. 25, 1997

Related U.S. Application Data

[63] Continuation of Ser. No. 809,252, Dec. 18, 1991, abandoned, which is a continuation of Ser. No. 221,909, Jun. 30, 1988, abandoned.

[51] Int. Cl.[6] ..... D21H 21/06

[52] U.S. Cl. ..... 162/158; 162/168.2; 162/168.3; 162/179; 162/183

[58] Field of Search ..... 162/158, 168.3, 162/168.2, 179, 183

[56] References Cited

U.S. PATENT DOCUMENTS

| | | | |
|---|---|---|---|
| 3,234,076 | 2/1966 | Goldsmith | 162/168.3 |
| 4,017,431 | 4/1977 | Aldrich | 162/158 |
| 4,295,931 | 10/1981 | Dumas | 162/158 |
| 4,606,773 | 8/1986 | Novak | 162/168.3 |

FOREIGN PATENT DOCUMENTS

| | | |
|---|---|---|
| 2393011 | 5/1978 | France . |
| 7212521 | 4/1972 | Japan . |

*Primary Examiner*—Peter Chin
*Attorney, Agent, or Firm*—Birch, Stewart, Kolasch & Birch, LLP

[57] ABSTRACT

This invention relates to a process for papermaking which comprises forming a sheet in the presence of a neutral sizing agent and optionally a filler using as a paper quality improver a cationic polymer which is prepared by copolymerizing an acrylamide compound of the formula:

$$CH_2{=}C(R_1)CONH_2$$

wherein $R_1$ is hydrogen atom or methyl group, and an inorganic or organic acid salt of a diallylamine compound of the formula:

$$[CH_2{=}C(R_2)CH_2]_2N{-}R_3$$

wherein $R_2$ is hydrogen atom or methyl group, $R_3$ is hydrogen atom or an alkyl having 1 to 6 carbon atoms, in the presence or absence of a vinyl monomer copolymerizable with said acrylamide compound and/or said diallylamine compound salt.

When the above paper quality improver is used, the yield per each additive particularly in case of neutral or alkaline papermaking is excellent and hence the sizing properties are sufficiently given, and there can be obtained a paper having sufficiently improved paper strength.

19 Claims, No Drawings

PROCESS FOR MAKING PAPER

This application is a continuation of Ser. No. 07/809,252, filed on Dec. 18, 1991, now abandoned which is a continuation of Ser. No. 07/221,909 filed on Jun. 30, 1988, now abandoned.

TECHNICAL FIELD

This invention relates to a process for making paper. More particularly, it relates to a process for making paper which comprises forming a sheet from a pulp slurry containing a neutral sizing agent and optionally a filler using a specific cationic polymer as a paper quality improver.

TECHNICAL BACKGROUND

There has recently been employed a papermaking process such as a so-called neutral or alkaline papermaking process which is carried out at pH 6 to 10, instead of an acidic papermaking process.

The neutral or alkaline papermaking process has advantages such that (1) a smaller energy for beating is used; (2) corrosion of machinery is reduced; (3) the white water system can be closed; (4) selection of fillers is not restricted and inexpensive calcium carbonate can be used; (5) deterioration of paper over time is reduce; (6) printability exhibited by the paper is good, and the like.

On the other hand, the neutral or alkaline papermaking process has drawbacks such that (1) expensive neutral sizing agents such as alkylketene dimers, alkenylsuccinic anhydrides, etc. must be used instead of inexpensive rosin sizing agents, and further, such agents are poor in anchoring onto the pulp; (2) fillers are poor in anchoring onto the pulp; (3) when the amount of calcium carbonate is increased, the strength of the paper is lowered; and the like.

It is known to use Mannich reaction products of an acrylamide polymer or acrylamide-acrylonitrile copolymer as an agent for reinforcing the paper strength in the papermaking under neutral conditions, but these agents are insufficiently anchored onto the pulp, and hence, satisfactory reinforcement of paper strength is not expected. Besides, there are also known polymers prepared by converting a part or whole of the tertiary amines in the above Mannich reaction products into quaternary groups. Although the products can increase the paper strength reinforcing effect in the papermaking step under neutral conditions in comparison with non-quaternary products, the improvement is still insufficient, and the anchoring effect of the neutral sizing agent is poor and hence the desired sizing effect is not achieved. Moreover, there is known a copolymer comprising predominantly (meth)acrylamide and a quaternary product of dimethylaminoethyl(meth)acrylamide, but it is still poor in the paper strength reinforcing effect, and the sizing agent is poor in anchoring effect. There is also known a copolymer comprising predominantly (meth)acrylamide and a quaternary product of dimethylaminopropyl(meth)acrylamide, but it is still poor in the paper strength reinforcing effect like the above polymer, and the sizing agent is poor in anchoring effect and hence a good sizing effect can not be achieved.

Besides, there is known a copolymer comprising predominantly (meth)acrylamide and diallyldimethylammonium chloride, but the sizing agent is poor in anchoring effect and hence the desired sizing effect can not be achieved.

Moreover, it is disclosed in Japanese Patent Second Publication (Kokoku) No. 12521/1972 to use a polymer having a partial quaternary group which is produced by copolymerizing diallylamine and a copolymerizable vinyl monomer [e.g. (meth)acrylamide], followed by modifying with an agent for converting into a quaternary group. However, such a polymer is particularly insufficient in the anchoring of the sizing agent and hence can not provide good sizing effect, while the paper strength reinforcing effect is improved.

Although there are also known one or more cationic polymers (e.g. polyamide/epichlorohydrin resin, etc.) and cationic starch, these are still not satisfactory in providing the desired effects. From these standpoints, it has been desired to develop an improved paper quality which is excellent in the yield of the product per sizing agent and filler and has excellent paper strength reinforcing effects.

DISCLOSURE OF THE INVENTION

The present inventors have intensively studied an improved process for making a paper having sufficient sizing effect and excellent paper strength owing to the excellent yielding effect of each of the additives in the papermaking process particularly under neutral or alkaline condition, by using a neutral sizing agent and optionally a filler, and the present invention has been accomplished.

The invention provides a process for papermaking which comprises forming a sheet at a pH 6 to 10 in the presence of a neutral sizing agent, and optionally a filler, using as a paper quality improver a cationic polymer which is prepared by copolymerizing (a) an acrylamide compound of the formula:

$$CH_2{=}C(R_1)CONH_2$$

wherein $R_1$ is a hydrogen atom or methyl group, and (b) an inorganic or organic acid salt of a diallylamine compound of the formula:

$$[CH_2{=}C(R_2)CH_2]_2N{-}R_3$$

wherein $R_2$ is a hydrogen atom or methyl group, and $R_3$ is a hydrogen atom or an alkyl having 1 to 6 carbon atoms, in the presence or absence of (c) a vinyl monomer copolymerizable with said acrylamide compound and/or said diallylamine compound salt.

The acrylamide compounds used as the component (a) in this invention include acrylamide or methacrylamide.

The diallylamines used as the component (b) include, for example, diallylamine, diallylmethylamine, diallylethylamine, diallylbutylamine, etc., and these are used in the form of a salt with an inorganic acid (e.g. hydrochloric acid, nitric acid, sulfuric acid, phosphoric acid, etc.) and an organic acid (e.g. formic acid, acetic acid, propionic acid, etc.). Among these, the diallylamine salts are most preferable.

The component (c) which is optionally used in this invention includes any nonionic, cationic or anionic vinyl monomers which are copolymerizable with the component (a) and/or the component (b). Examples of the nonionic monomer are methyl acrylate, methyl methacrylate, ethyl acrylate, ethyl methacrylate, acrylonitrile, methacrylonitrile, styrene, hydroxyethyl acrylate, hydroxyethyl methacrylate, vinyl acetate, and the like.

Examples of the cationic monomer are dimethylaminoethyl acrylate, dimethylaminoethyl methacrylate, diethylaminoethyl acrylate, diethylaminoethyl methacrylate, dimethylaminopropylacrylamide, dimethylaminopropylmethacrylamide, and the like, or the quaternary derivatives of these compounds, diallyldimethylammonium chloride, vinylpyridine, vinylpyrrolidone, and the like.

Examples of the anionic monomer are acrylic acid, methacrylic acid, vinylsulfonic acid, maleic acid, and the like.

The ratio of the components (a), (b) and (c) used in the copolymerization of this invention is preferably for component (a): 40 to 99% by mole, more preferably 50 to 97% by mole, for component (b): 1 to 60% by mole, more preferably 3 to 50% by mole, and the component (c) can be used in any amount unless the effect of this invention is inhibited but may be restricted by the water solubility and ionic properties thereof. In the case of a nonionic monomer, it should be used within such an amount that the produced polymer does not lose its water solubility. In the case of a cationic monomer, it is used in an amount of not more than 40% by mole, preferably not more than 30% by mole. In case of an anionic monomer, it is used in the range of less than the amount of the component (b).

When the component (a) is used in an amount of less than 40% by mole or the component (b) is used in an amount of less than 1% by mole, the effect of this invention can not sufficiently be achieved, and when the component (c) is used in an amount of over 40% by mole, it is the same situation.

The production of the copolymer in this invention can be carried out by a known process, and the polymerization manner is not specified, but it is preferably done by reacting in water or a mixed solvent of water and a water soluble solvent in the presence of a polymerization initiator.

The polymerization initiator includes any conventional initiators, for example, persulfates (e.g. ammonium persulfate, potassium persulfate, etc.), azo compounds (e.g. 2,2'-diamidinyl-2,2'-azopropane dihydrochloride, azobisisobutyronitrile, etc.), peroxides (e.g. di-t-butyl peroxide, cumene hydroperoxide, hydrogen peroxide, etc.), and the like. There may also be used known Redox initiators, such as potassium persulfate and sodium bisulfide, or a combination with tertiary amines.

The polymerization is usually carried out at 10° to 100° C., preferably 40° to 80° C., for 1 to 10 hours. The polymerization may be done in the presence of oxygen, but preferably done under an atmosphere of inert gas such as nitrogen gas.

The component (a), component (b) and optional component (c) may wholly be charged at one time and then subjected to the polymerization, or alternatively, a part or whole of a certain component may be charged after initiation of the polymerization of other components, and the component may be added continuously or partially.

In this invention, the cationic polymer thus prepared is used as a paper quality improver, and the amount thereof depends on the kinds of paper, desired degree of sizing, the desired strength of paper, and the like, but is usually used in an amount of 0.01 to 2% by weight, preferably 0.05 to 1% by weight, when calculated as solid polymer based on the weight of the paper in dry state.

The cationic polymer used in this invention may be used alone or in combinations with other ingredients (e.g. sizing anchoring agent, yield improver, etc.).

The filler used optionally in this invention includes, for example, calcium carbonate, kaolin, clay, talc, $TiO_2$, satin white, and the like. The neutral sizing agent used in this invention includes, for example, alkylketene dimers, alkenylsuccinic anhydride, isocyanate aziridine derivatives, carbonyl derivatives, fatty acid anhydrides, and the like.

According to this invention, the sheet forming is carried out by using the above cationic polymer, neutral sizing agent and optionally filler at pH 6 to 10. The process is not specified but includes any conventional processes. In the so-called beater-addition process, a filler and a sizing agent are both added to an aqueous suspension of pulp fibers and the mixture is subjected to the sheet forming. In the beater-addition process, the order of addition of additives is not specified.

The cationic polymer of this invention may be used alone or in combinations with other ingredients (e.g. sizing anchoring agent, yield improvers, etc.).

This invention is illustrated by the following Examples, but is not limited thereto. In Examples, "%" means % by weight unless specified otherwise.

PREPARATION 1

A 50% aqueous solution of diallylamine hydrochloride (42.8 g, 0.16 mole), a 50% aqueous solution of acrylamide (34.1 g, 0.24 mole), isopropyl alcohol (7.7 g) and deionized water (171.6 g) were charged into a reactor provided with a stirrer, and the mixture was regulated to pH 7.0 with a slight amount of 28% aqueous sodium hydroxide. The reactor was purged with nitrogen gas to remove oxygen within the vessel, and thereafter, ammonium persulfate (0.12 g) was added thereto at 55° C., and the mixture was reacted at 55° C. for 6 hours. By quantitative determination of unreacted monomer, it was confirmed that the degree of reaction was 99% or more.

The product had a polymer content of 15%, pH 4.3, and Brookfield viscosity (25° C.) of 65 ps.

PREPARATION 2

A 50% aqueous solution of diallylamine hydrochloride (10.7 g, 0.04 mole) and deionized water (144.1 g) were charged into a reactor provided with a stirrer, and the mixture was regulated to pH 7.0 with a slight amount of 28% aqueous sodium hydroxide. The reactor was purged with nitrogen gas to remove oxygen within the vessel, and thereafter, ammonium persulfate (0.28 g) was added thereto at 70° C. With keeping the inner temperature at 70° C., a 50% acrylamide (51.2 g, 0.36 mole) was added to the reaction system over a period of 2 hours. Thereafter, the mixture was reacted at 70° C. for 2 hours. By quantitative determination of unreacted monomer, it was confirmed that the degree of reaction was 99% or more.

The product had a polymer content of 15%, pH 3.5, and Brookfield viscosity (25° C.) of 50 ps.

PREPARATION 3

A 98% diallylmethylamine hydrochloride (3.8 g, 0.025 mole) and deionized water (97.6 g) were charged into a reactor provided with a stirrer, and the mixture was regulated to pH 7.0. The reactor was purged with nitrogen gas to remove oxygen within the vessel, and thereafter, ammonium persulfate (0.1 g) was added thereto at 70° C. With keeping the inner temperature at 70° C., a 50% aqueous solution of acrylamide (32.0 g, 0.225 mole) was added to the reaction system over a period of 2 hours. Thereafter, the mixture was reacted at 70° C. for 2 hours. By quantitative determination of unreacted monomer, it was confirmed that the degree of reaction was 99% or more.

The product had a polymer content of 15%, pH 3.9, and Brookfield viscosity (25° C.) of 55 ps.

PREPARATION 4

A 50% aqueous solution of diallylamine hydrochloride (10.7 g, 0.04 mole) and deionized water (141.8 g) were charged into a reactor provided with a stirrer, and the mixture was regulated to pH 6.8 with a slight amount of 28% aqueous sodium hydroxide. The reactor was purged with nitrogen gas to remove oxygen within the vessel, and thereafter, 2,2'-diamidinyl-2,2'-azopropane dihydrochloride (0.27 g) was added thereto at 70° C. With keeping the inner temperature at 70° C., a mixture of a 50% aqueous solution of acrylamide (40.9 g, 0.288 mole) and acrylonitrile (3.8 g, 0.072 mole) was added to the reaction system over a period of 3 hours. Thereafter, the mixture was reacted at 70° C. for 3 hours. By quantitative determination of unreacted monomer, it was confirmed that the degree of reaction was 99% or more.

The product had a polymer content of 15%, pH 3.4, and Brookfield viscosity (25° C.) of 43 ps.

PREPARATIONS 5 to 12

In the same manner as described in Preparations 1 to 4 except that the monomer and monomer composition were changed, there were produced various polymers. The results are shown in Table 1.

TABLE 1

| Prep. No. | Monomer (a) (% by mole) | Monomer (b) (% by mole) | Monomer (c) (% by mole) | Concentration of aqueous polymer solution | Viscosity of aqueous polymer solution (25° C.) | pH of aqueous polymer solution |
|---|---|---|---|---|---|---|
| 5 | Acrylamide (70) | Diallylamine sulfate (30) | — | 15% | 55 ps | 3.9 |
| 6 | Acrylamide (45) | Diallylamine acetate (25) | Acrylonitrile (30) | 15% | 48 ps | 4.2 |
| 7 | Acrylamide (65) | Diallylamine hydrochloride (15) | Vinyl acetate (20) | 15% | 39 ps | 4.2 |
| 8 | Acrylamide (70) | Diallylamine hydrochloride (20) | Acrylic acid (10) | 15% | 45 ps | 3.8 |
| 9 | Acrylamide (80) | Diallylamine hydrochloride (10) | Dimethylaminoethyl acryiate (10) | 15% | 38 ps | 4.0 |
| 10 | Acrylamide (40) | Diallylamine hydrochloride (60) | — | 15% | 54 ps | 3.8 |
| 11 | Methacrylamide (90) | Diallylmethylamine sulfate (10) | — | 15% | 73 ps | 3.9 |
| 12 | Acrylamide (80) | Dimethallylamine hydrochloride (20) | — | 15% | 65 ps | 4.1 |

REFERENCE PREPARATION 1

A 15% aqueous solution of acrylamide was reacted with ammonium persulfate (0.5% by weight per weight of acrylamide), where the degree of polymerization was controlled by using isopropyl alcohol to give an aqueous solution of polyarylamide having pH 3.4 and a viscosity of 114 ps.

Thereafter, to the aqueous solution of polyacrylamide (473.8 g, 1.0 mole calculated as the acid amide group) were added a 50% aqueous solution of dimethylamine (19.8 g, 0.22 mole) and a 37% formalin (16.2 g, 0.2 mole), and the mixture was subjected to Mannich reaction by keeping it at 45° C. for one hour. To the aqueous solution was further added dimethyl sulfate (22.7 g, 0.18 mole), and the mixture was kept at 15°–20° C. for about 5 hours, by which the reaction for convertion of amino group into quaternary group was completed. After completion of the conversion reaction into quaternary group, the aqueous solution of polymer was regulated to the desired pH and concentration with aqueous sodium carbonate solution and deionized water to give an aqueous solution of polymer having a polymer content of 15%, pH 3.2 and Brookfield viscosity (25° C.) of 25 ps.

REFERENCE PREPARATION 2

A 50% aqueous solution of acrylamide (48.3 g, 0.34 mole), dimethylaminoethyl methacrylate which was converted into quaternary compound with methyl chloride (12.5 g, 0.06 mole), deionized water (176.0 g), and isopropyl alcohol (7.3 g) were charged into a reactor provided with a stirrer, and the reactor was purged well with nitrogen gas. Ammonium persulfate (0.21 g) was added thereto at 60° C., and thereafter, the mixture was reacted at 60° C. for 4 hours. It was confirmed that the degree of reaction was 99% or more.

The product had a polymer content of 15%, pH 3.2, and Brookfield viscosity (25° C.) of 37 ps.

REFERENCE PREPARATION 3

A 50% aqueous solution of acrylamide (51.2 g, 0.36 mole), dimethylaminopropyl methacrylate which was converted into quaternary compound with methyl chloride (8.83 g, 0.04 mole), deionized water (162.6 g), and isopropyl alcohol (6.9 g) were charged into a reactor provided with a stirrer, and the reactor was purged well with nitrogen gas. Ammonium persulfate (0.19 g) was added thereto at 60° C., and thereafter, the mixture was reacted at 60° C. for 4 hours. The degree of reaction was 99% or more.

The product had a polymer content of 15%, pH 4.7, and Brookfield viscosity (25° C.) of 42 ps.

REFERENCE PREPARATION 4

A 70% diallyldimethylammonium chloride (5.8 g, 0.025 mole) and deionized water (95.7 g) were charged into a reactor provided with a stirrer, and the the mixture was regulated to pH 7.0 with a slight amount of 28% aqueous sodium hydroxide solution. Thereafter, the reactor was purged with nitrogen gas to remove oxygen within the vessel, and then ammonium persulfate (0.10 g) was added thereto at 70° C. Thereafter, with keeping the inner temperature at 70° C., a 50% acrylamide (32.0 g, 0.225 mole) was added over a period of 2 hours. Thereafter, the mixture was reacted at 70° C. for 2 hours. By quantitative determination of unreacted monomer, it was confirmed that the degree of reaction was 99% or more.

The product had a polymer content of 15%, pH 3.9, and Brookfield viscosity (25° C.) of 46 ps.

EXAMPLES 1 TO 12 AND REFERENCE EXAMPLES 1 TO 4

The sheet forming was carried out by using the cationic polymers as prepared in Preparations and Reference Preparations as an agent for neutral papermaking.

By using N/L (1/1) BKP (C.S.F=410 ml), to a slurry of pulp (pulp concentration: 7.5 g/l) were added $CaCO_3$ (10% per pulp weight), AQUAPEL 12 (an alkylketene dimer type neutral sizing agent, manufactured by DIC Hercules, 0.1 % per pulp weight) and the cationic polymer (0.15% per pulp weight), and the mixture was subjected to sheet forming at a slurry pH 8.5 so that the basis weight became 60 g/m$^2$ (based on the regulation by TAPPI). Thereafter, the paper was dehydrated at 4 kg/cm$^2$ for 7 minutes and dried at 110° C. for 4 minutes. Thereafter, the sheet was kept at 20° C., 65 RH for 15 hours in order to control the humidity, and then various properties of the paper was measured. The results are shown in Table 2. The properties were measured in the following manner.

Internal bond was measured with Internal Bond Tester (manufactured by Kumagaya Riki Kogyo K.K.). Stöckigt sizing degree was measured in a similar manner as described in JIS-P-8122 (a test method for measuring Stöckigt sizing degree of paper). The yield per $CaCO_3$ was measured in a similar manner as described in JIS-P-8128 (a test method for measuring ash content of paper and paper board).

TABLE 2

| Sample No. | Internal bond (kg/cm) | Stöckigt sizing degree (seoond) | Yield per $CaCO_3$ (%) |
|---|---|---|---|
| Ex. 1 | 2.69 | 29.8 | 76.8 |
| Ex. 2 | 2.74 | 30.2 | 77.3 |
| Ex. 3 | 2.39 | 21.3 | 67.5 |
| Ex. 4 | 2.68 | 29.4 | 73.4 |
| Ex. 5 | 2.60 | 28.1 | 75.3 |
| Ex. 6 | 2.73 | 28.5 | 74.7 |
| Ex. 7 | 2.72 | 29.0 | 72.8 |
| Ex. 8 | 2.80 | 29.7 | 73.1 |
| Ex. 9 | 2.61 | 29.9 | 74.2 |
| Ex. 10 | 2.75 | 28.8 | 75.6 |
| Ex. 11 | 2.48 | 20.7 | 68.7 |
| Ex. 12 | 2.76 | 29.5 | 74.7 |
| Ref. Ex. 1 | 2.50 | 7.5 | 59.6 |
| Ref. Ex. 2 | 1.98 | 6.8 | 51.2 |
| Ref. Ex. 3 | 1.97 | 9.4 | 60.3 |
| Ref. Ex. 4 | 2.10 | 8.5 | 52.5 |
| Control | 1.68 | 0 | 14.4 |

We claim:

1. A process for papermaking which consists essentially of mixing an aqueous pulp slurry with a neutral sizing agent and a cationic polymer as a paper quality improver, and forming the mixed slurry into a paper sheet at a pH of 6 to 10, said cationic polymer showing Brookfield viscosity of at most about 73 ps at 25° C. in an aqueous solution containing 15% by weight of the polymer, and being prepared by copolymerizing the components consisting essentially of (a) an acrylamide compound of the formula:

$$CH_2{=}C(R_1)CONH_2$$

wherein $R_1$ is a hydrogen atom or methyl group; and (b) an inorganic or organic acid salt of a secondary or tertiary diallylamine compound of the formula:

$$(CH_2{=}C(R_2)CH_2)_2N{-}R_3$$

wherein $R_2$ is a hydrogen atom or methyl group, and $R_3$ is a hydrogen atom or an alkyl group having 1 to 6 carbon atoms, wherein said component (a) is present in an amount of 50 to 97% by mole and said component (b) is present in an amount of 3 to 50% by mole, and wherein the cationic polymer is present in an amount of 0.01 to 2% by weight when calculated as solid polymer based on the weight of the paper in a dry state.

2. The process of claim 1, wherein said aqueous pulp slurry is mixed additionally with a filler.

3. The process of claim 1, wherein said component (a) is acrylamide.

4. The process of claim 1, wherein said component (a) is methacrylamide.

5. The process of claim 1, wherein said component (b) is a salt of a member selected from the group consisting of diallylamine, diallylmethylamine, diallylethylamine, diallylbutylamine and dimethallylamine.

6. The process of claim 1, wherein said component (b) is a diallylamine salt.

7. The process of claim 1, wherein said cationic polymer is prepared by copolymerizing said components (a) and (b) in water or in a mixed solvent of water and a water-soluble solvent in the presence of a polymerization initiator.

8. The process of claim 1, wherein said cationic polymer is prepared by copolymerizing said components (a) and (b) at a temperature of 10° to 100° C. for 1 to 10 hours under an atmosphere of inert gas.

9. The process of claim 1, wherein said cationic polymer is present in an amount of 0.01 to 2% by weight in said paper sheet.

10. The process of claim 1, wherein said neutral sizing agent is selected from the group consisting of alkylketene dimers and alkenylsuccinic anhydrides.

11. The process of claim 1, wherein the cationic polymer is present in an amount of 0.05 to 1% by weight.

12. A process for papermaking which consists essentially of mixing an aqueous pulp slurry with a neutral sizing agent and a cationic polymer as a paper quality improver, and forming the mixed slurry into a paper sheet at a pH of 6 to 10, said cationic polymer showing Brookfield viscosity of at most about 73 ps at 25° C. in an aqueous solution containing 15% by weight of the polymer, and being prepared by copolymerizing the components consisting essentially of (a) an acrylamide compound of the formula:

$$CH_2{=}C(R_1)CONH_2$$

wherein $R_1$ is a hydrogen atom or methyl group;

(b) an inorganic or organic acid salt of a secondary or tertiary diallylamine compound of the formula:

$$(CH_2{=}C(R_2)CH_2)_2N{-}R_3$$

wherein $R_2$ is a hydrogen atom or methyl group, and $R_3$ is a hydrogen atom or an alkyl group having 1 to 6 carbon atoms; and (c) a vinyl monomer copolymerizable with said component (a) and/or (b), wherein said component (a) is present in an amount of 50 to 97% by mole, said component (b) is present in an amount of 3 to 50% by mole, and said component (c) is present in an amount of not more than 30% by mole, and wherein the cationic polymer is present in an amount of 0.01 to 2% by weight when calculated as solid polymer based on the weight of the paper in a dry state.

13. The process of claim 12, wherein said aqueous pulp slurry is mixed additionally with a filler.

14. The process of claim 12, wherein said component (c) is a nonionic vinyl monomer selected from the group consisting of methyl acrylate, methyl methacrylate, ethyl acrylate, ethyl methacrylate, acrylonitrile, methacrylonitrile, styrene, hydroxyethyl acrylate, hydroxyethyl methacrylate and vinyl acetate; a cationic vinyl monomer selected from the group consisting of dimethylaminoethyl acrylate, dimethylaminoethyl methacrylate, diethylaminoethyl acrylate, diethylaminoethyl methacrylate, dimethylaminopropylacrylamide, dimethylaminopropylmethacrylamide, diallyldimethylammonium chloride, vinylpyridine and vinylpyrrolidone; or an anionic vinyl monomer selected from the group consisting of acrylic acid, methacrylic acid, vinylsulfonic acid and maleic acid.

15. The process of claim 12, wherein said cationic polymer is prepared by copolymerizing said components (a), (b) and (c) in water or in a mixed solvent of water and a water soluble solvent in the presence of a polymerization initiator.

16. The process of claim 12, wherein said cationic polymer is prepared by copolymerizing said components (a), (b) and (c) at a temperature of 10° to 100° C. for 1 to 10 hours under an atmosphere of inert gas.

17. The process of claim 12, wherein said cationic polymer is present in an amount of 0.01 to 2% by weight in said paper sheet.

18. The process of claim 12, wherein said neutral sizing agent is selected from the group consisting of alkylketene dimers and alkenylsuccinic anhydrides.

19. The process of claim 12, wherein the cationic polymer is present in an amount of 0.05 to 1% by weight.

* * * * *